US008727726B2

(12) United States Patent
Butkiewicz

(10) Patent No.: US 8,727,726 B2
(45) Date of Patent: May 20, 2014

(54) TURBINE ENDWALL COOLING ARRANGEMENT

(75) Inventor: Jeffrey John Butkiewicz, Greenville, SC (US)

(73) Assignee: General Electric Company, Schenectady, NY (US)

( * ) Notice: Subject to any disclaimer, the term of this patent is extended or adjusted under 35 U.S.C. 154(b) by 766 days.

(21) Appl. No.: 12/538,923

(22) Filed: Aug. 11, 2009

(65) Prior Publication Data

US 2011/0038708 A1 Feb. 17, 2011

(51) Int. Cl.
*F01D 25/12* (2006.01)

(52) U.S. Cl.
USPC ..... 416/97 R

(58) Field of Classification Search
USPC ..... 416/96 R, 97 R
See application file for complete search history.

(56) References Cited

U.S. PATENT DOCUMENTS 6,174,134 B1 * 1/2001 Lee et al. ..... 416/97 R
6,309,175 B1 10/2001 Hahnle et al.
6,341,939 B1 * 1/2002 Lee ..... 416/97 R
6,435,814 B1 * 8/2002 Yu et al. ..... 415/115
6,514,037 B1 * 2/2003 Danowski et al. ..... 415/115
6,830,432 B1 * 12/2004 Scott et al. ..... 416/97 R
7,249,933 B2 * 7/2007 Lee et al. ..... 416/97 R
8,167,557 B2 * 5/2012 Elliott et al. ..... 416/97 R
2004/0265128 A1 12/2004 Scott et al.
2005/0095128 A1 5/2005 Benjamin et al.
2006/0078417 A1 4/2006 Benton
2006/0153681 A1 7/2006 Lee et al.
2006/0171807 A1 * 8/2006 Lee ..... 416/97 R
2007/0128030 A1 * 6/2007 Liang ..... 416/97 R
2008/0085190 A1 4/2008 Liang

OTHER PUBLICATIONS

Unofficial English translation of CN Office Action dated Dec. 3, 2013, issued in connection with corresponding CN Application No. 201010260539.2.

* cited by examiner

*Primary Examiner* — Nathaniel Wiehe
*Assistant Examiner* — Woody A Lee, Jr.
(74) *Attorney, Agent, or Firm* — Cantor Colburn LLP

(57) ABSTRACT

An airfoil is provided and includes an airfoil body having a pressure surface extendable between radial ends and a fluid path in an airfoil interior defined therein. The pressure surface is formed to further define a passage by which coolant is deliverable from the fluid path in the airfoil interior, in a perimetric direction from the pressure surface for the purpose of cooling a portion on the surface of the radial end.

10 Claims, 4 Drawing Sheets

TURBINE ENDWALL COOLING ARRANGEMENT

BACKGROUND OF THE INVENTION

The subject matter disclosed herein relates to a turbine endwall.

In gas turbines, turbine endwall distress may occur due to high temperatures and large temperature gradients. A turbine endwall can be located at either the stator or the rotor and at either the inner diameter or the outer diameter of the turbine and is generally oriented such that turbine airfoils extend radially away from an endwall surface.

Types of endwall distress experienced in the field include, but are not limited to, oxidation, spallation, cracking, bowing and liberation of the endwall components. Accordingly, various approaches have been attempted to address this problem. In general, these approaches employ cooling enhancements for endwall surfaces, the creation of convection cooling passages within the endwall and/or additions of components that provide for local film cooling with low-momentum flow.

BRIEF DESCRIPTION OF THE INVENTION

According to one aspect of the invention, an airfoil is provided and includes an airfoil body having a pressure surface extendable between radial ends and a fluid path in an airfoil interior defined therein. The pressure surface is formed to further define a passage by which coolant is deliverable from the fluid path in the airfoil interior, in a perimetric direction away from the pressure surface.

According to another aspect of the invention, a turbine is provided and includes an endwall, including a surface and a plurality of airfoils affixable to the surface with portions of the surface being disposed between ends of adjacent airfoils, each of the airfoils including an airfoil body having a pressure surface and a fluid path in an airfoil interior defined therein, the pressure surface being formed to define a passage by which coolant is deliverable from the fluid path in the airfoil interior toward one of the surface portions.

According to yet another aspect of the invention, a method of forming a turbine is provided and includes fashioning a plurality of airfoils, each of which has a pressure surface and a fluid path in an airfoil interior defined therein, affixing the plurality of the airfoils to an endwall, the endwall including surface portions disposable between adjacent radial ends of the airfoils and defining a passage through the pressure surface of the airfoil by which coolant is deliverable from the fluid path in the airfoil interior toward one of the surface portions of the endwall.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
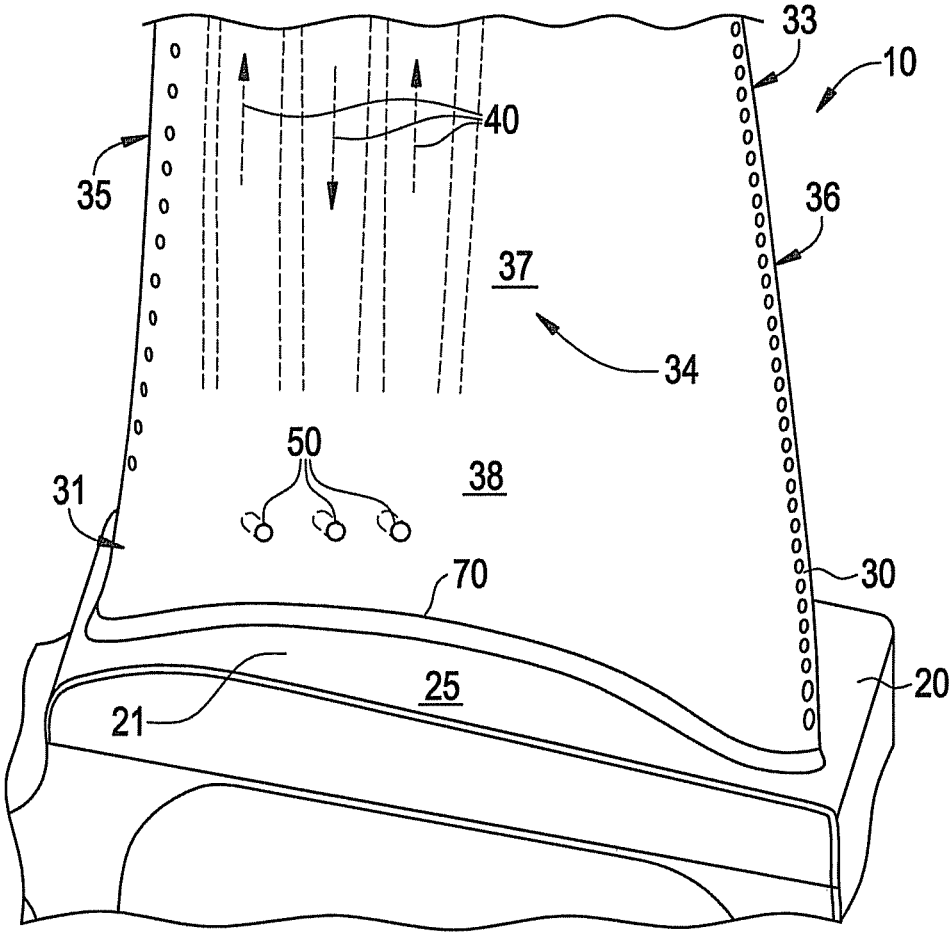
FIG. 1 is a perspective view of a turbine airfoil and an endwall.

With reference to FIG. 1, a turbine 10 is provided. A section of the turbine 10 includes an endwall 20 and a plurality of airfoils 30. The endwall 20 includes a surface 21 to which each of the airfoils 30 is affixable with portions 25 of the surface 21 being disposed between ends 31 of adjacent pairs of the airfoils 30. Each of the airfoils 30 includes opposing suction and pressure surfaces 33 and 34, which meet at respective leading and trailing edges 35 and 36, to define an airfoil 30 shape having a fluid path 38 in an airfoil interior 37 through which a cooling circuit 40 is extendable. As is well known, the suction surface 33 is generally convex and the pressure surface 34 is generally concave. In addition, the pressure surface 34 is formed to define a passage 50 or, in some embodiments, a set of passages 50, by which coolant is deliverable toward one of the surface portions 25. In accordance with various embodiments, the coolant may be deliverable from for example the fluid path 38, the cooling circuit 40 and/or another structure of the airfoil 30.

It will be understood that the surface portions 25 may be defined as areas of the surface 21 that are prone to be relatively highly heated as a result of a migration of hot gases toward the endwall 20 that can occur during operation of the turbine 10. In that sense, the surface portions 25 are generally disposed between the ends 31 of adjacent pairs of the airfoils 30 as well as at downstream locations.

Each passage 50 is positioned and oriented such that the coolant, including for example cooling air from the cooling circuit 40, is expelled from the passage 50 and is entrained in passage cross-flow. The coolant thereby blankets the surface portion 25 and serves as a barrier separating the surface portion 25 from the migration of hot gases and, thus, temperatures at the surface portion 25 are reduced. Also, with the passage 50 disposed from within a main section of the airfoil 30, the coolant is expelled from locations of the airfoil 30 with direct access to cooling circuit 38 or 40 and at a region of comparatively low stress levels. Furthermore, since the coolant is expelled at axial locations upstream from a blade row throat, it is possible that relatively useful work can be extracted from the cooling flow.

Figure 2:
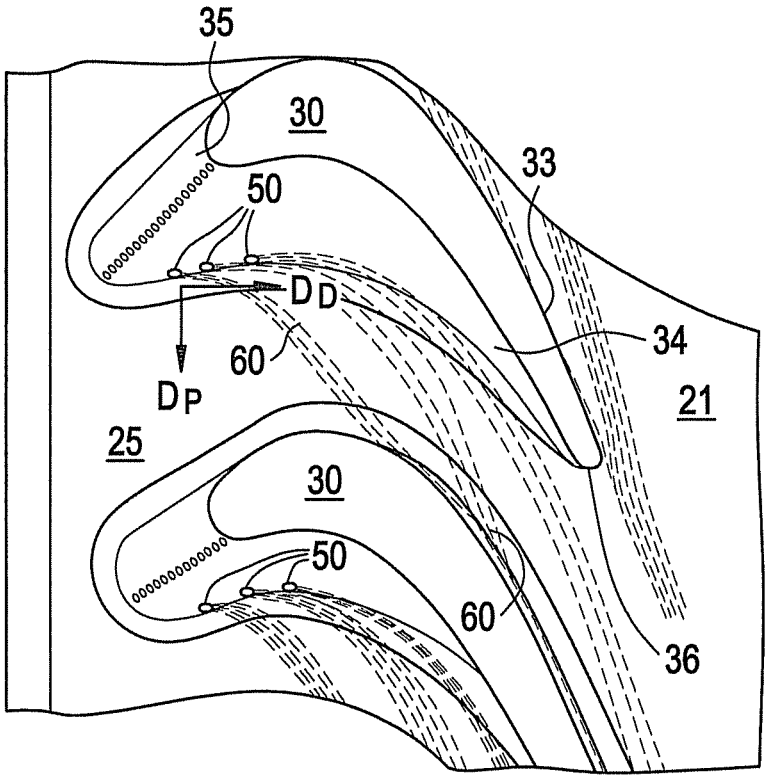
FIG. 2 is a radial view of a flow of coolant leaving the turbine airfoil of FIG. 1.
Figure 3:
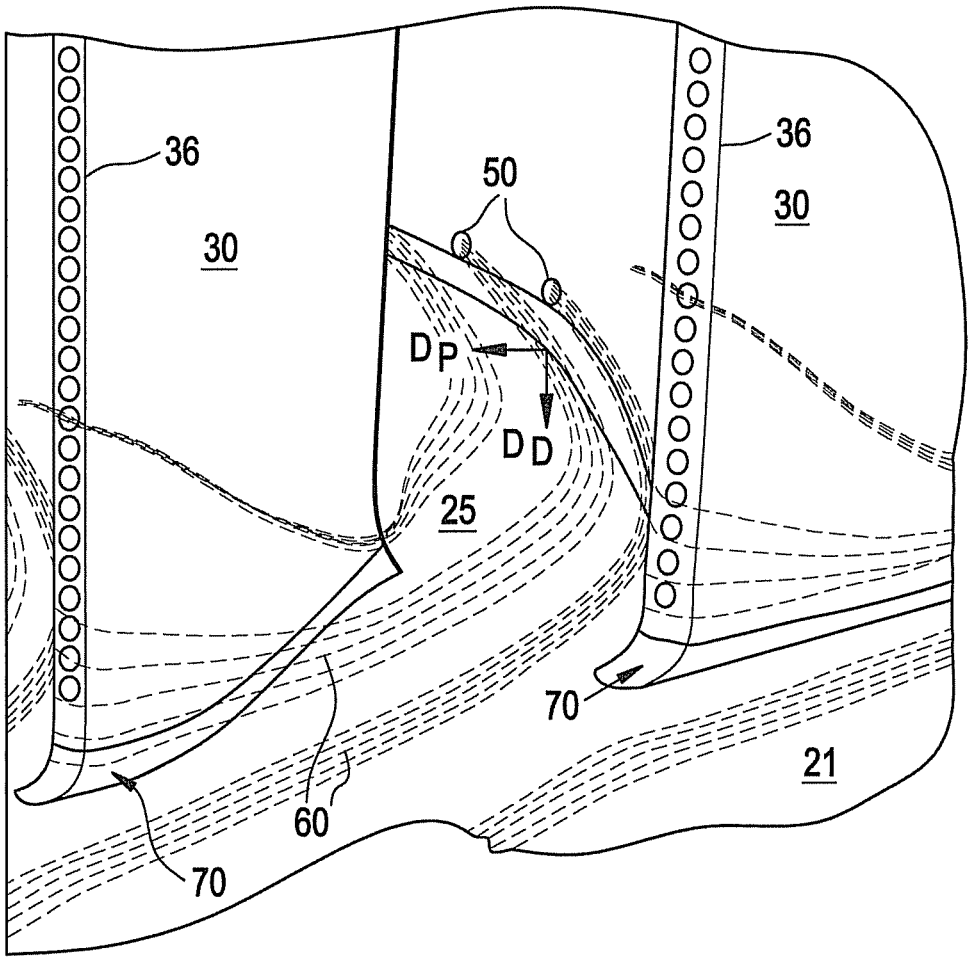
FIG. 3 is an axial view of the flow of the coolant of FIG. 2.

Still referring to FIG. 1, the passage 50 is generally defined in the pressure surface 34 to be closer to the leading edge 35 of the airfoil 30 than the trailing edge 36. This way, coolant leaving the passage 50 with perimetric momentum flows downstream and remains able to blanket the surface portion 25. This can be seen in FIGS. 2 and 3, in which the flow of coolant is described by flow lines 60 that emerge from their corresponding passages 50 in the perimetric and downstream directions, $D_P$ and $D_D$, respectively.

Figure 4:
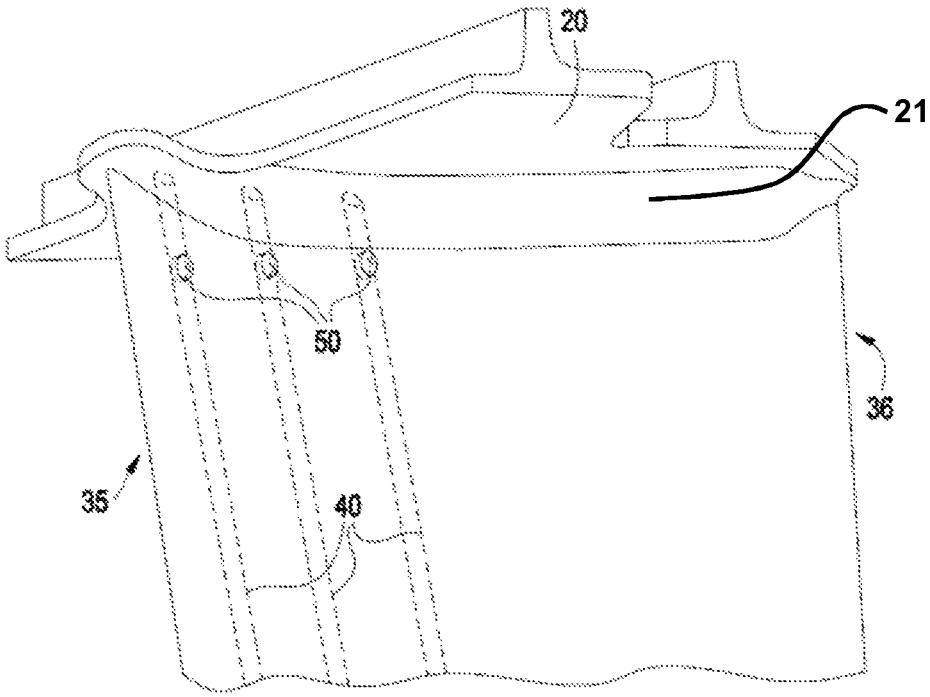
FIG. 4 is a perspective view of a turbine airfoil and an endwall.

In accordance with various embodiments of the invention and, with reference to FIGS. 1 and 4, the airfoil 30 and endwall 20 could be provided as components of the rotor or the stator of the turbine 10 and at the inner diameter or the outer diameter of the turbine 10. Where the endwall 20 is provided at the rotor and/or at the inner diameter of the turbine 10, the surface 21 faces radially outwardly. Here, the passage 50 is positioned outboard of an airfoil fillet 70, which is disposed at a radially inboard end 31 of the airfoil 30.

Although not required, the passage 50 in this case is also positioned less than about 25% or, in some cases, 50% of the radial length of the airfoil 30 from the radially inboard end 31. On the other hand, as shown in FIG. 4, where the endwall 20 is provided at the outer diameter of the turbine 10, the surface 21 of the endwall 20 faces radially inwardly with the passage 50 being positioned oppositely to the description above.

As shown in FIG. 1, the pressure surface 34 may be formed to define multiple passages 50. In this case, the multiple passages 50 may be arrayed in, e.g., a downstream direction from the leading edge 35. With this configuration, the coolant delivered to the surface 21 may flow over a greater surface area of the surface 21. This can be seen in FIGS. 2 and 3 in which the flow lines 60 flow over the surface portions 25 and portions of the surface 21 downstream from the airfoils 30. It is understood that the multiple passages 50 can be arranged in various formats, such as an array extending in the radial direction or an array extending in both the radial and the downstream directions.

The passage 50 is substantially tubular shaped and extends from the fluid path 38 in the interior 37 of the airfoil 30 to the pressure surface 34. In some cases, the passage 50 extends from the cooling circuit 40 to the pressure surface 34. Although it may be formed as a hollowed out region of the pressure surface, walls of the passage 50 may also be provided with additional components to increase, decrease or otherwise modify flow characteristics of the coolant. In addition, to insure that a sufficient but not excessive amount of coolant is removed from the cooling circuit 40, it is understood that the passage 50 may have irregular cross-sectional shapes that impede and/or facilitate the flow of the coolant.

The passage 50 can be applied to either new blade or vane designs or used as a repair option for existing components. As such, a method of forming a turbine 10 is provided and includes fashioning a plurality of airfoils 30, each of which has a pressure surface 34 and a fluid path in an airfoil interior 37 defined therein through which a cooling circuit 40 may be extendable. The method further includes affixing the plurality of the airfoils 30 to an endwall 20 where the endwall 20 includes a surface 21 and surface portions 25, which are disposable between ends of adjacent pairs of the airfoils 30. A passage 50 or a set of passages 50 is defined through the pressure surface 34. The passage 50 allows coolant to be deliverable from for example the fluid path 38 and/or the cooling circuit 40 and toward one of the surface portions 25.

In accordance with embodiments of the invention, the passage 50 may be machined or cast along with the airfoil 30. Where machining is employed, the method may further include identifying a relatively highly heatable section of the one of the surface portions 25 and machining the passage 50 such that the coolant is deliverable toward the identified relatively highly heatable section. This way, it is possible for the cooling benefits of the coolant flow to be increased.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An airfoil, comprising:

an inwardly facing endwall surface portion;

an airfoil body having a radially outboard end attached to the inwardly facing endwall surface portion, a pressure surface and multiple fluid paths in an airfoil interior defined therein; and a fillet disposed at the radially outboard end of the airfoil body, the pressure surface being formed to define a single linear array of passages at a radial location defined with an entirety of a radial span of the fillet radially interposed between the passage and the inwardly facing endwall surface portion, the single linear array of passages being closer to a leading edge of the airfoil than a trailing edge and including passages that are each respectively configured to exclusively deliver coolant from only a corresponding one of each of the fluid paths in the airfoil interior in a perimetric direction from the pressure surface and toward the endwall surface portion such that the delivered coolant flows across a radially innermost edge of the fillet prior to reaching the endwall surface portion.

2. The airfoil according to claim 1, wherein the single linear array of passages is defined at about 25-50% of the radial length of the airfoil from the radially outboard end.

3. The airfoil according to claim 1, wherein the single linear array of passages is positioned less than about 50% of the radial length of the airfoil from the radially outboard end.

4. The airfoil according to claim 1, wherein the single linear array of passages is arrayed in a downstream direction from the leading edge.

5. The airfoil according to claim 1, wherein each of the passages is substantially tubular shaped with a circumferentially circular cross-section.

6. The airfoil according to claim 1, wherein each of the passages is aligned in a substantially normal direction relative to the pressure surface.

7. The airfoil according to claim 1, wherein each of the passages is aligned to point in a radial direction relative to the endwall surface portion.

8. The airfoil according to claim 1, wherein the coolant is entrained by passage cross-flow.

9. The airfoil according to claim 1, wherein the coolant blankets the corresponding portion of the endwall surface portion.

10. The airfoil according to claim 1, wherein the coolant comprises cooling air supplied from a cooling circuit extendable within the airfoil interior.

* * * * *